US010984745B2

(12) United States Patent
Li

(10) Patent No.: US 10,984,745 B2
(45) Date of Patent: Apr. 20, 2021

(54) DRIVING METHOD AND DEVICE OF DISPLAY PANEL, AND DISPLAY DEVICE

(71) Applicants: HKC Corporation Limited, Guangdong (CN); Chongqing HKC Optoelectronics Technology Co., Ltd., Chongqing (CN)

(72) Inventor: Wenxin Li, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/625,192

(22) PCT Filed: Sep. 20, 2017

(86) PCT No.: PCT/CN2017/102425
§ 371 (c)(1),
(2) Date: Dec. 20, 2019

(87) PCT Pub. No.: WO2019/000658
PCT Pub. Date: Jan. 3, 2019

(65) Prior Publication Data

US 2020/0143763 A1 May 7, 2020

(30) Foreign Application Priority Data

Jun. 26, 2017 (CN) ..... 201710497538.1

(51) Int. Cl.
*G09G 3/36* (2006.01)

(52) U.S. Cl.
CPC ..... *G09G 3/3648* (2013.01); *G09G 3/3614* (2013.01); *G09G 2300/0478* (2013.01)

(58) Field of Classification Search
CPC ..... G09G 3/3614; G09G 2310/0286; G09G 3/3674–3681; G09G 3/3648;
(Continued)

(56) References Cited

U.S. PATENT DOCUMENTS

2004/0217935 A1* 11/2004 Jeon ..... G11C 19/28 345/100
2007/0097057 A1* 5/2007 Shin ..... G09G 3/3614 345/98

(Continued)

FOREIGN PATENT DOCUMENTS

CN 101399020 A 4/2009
CN 103236244 A 8/2013

(Continued)

*Primary Examiner* — Sanjiv D. Patel
(74) *Attorney, Agent, or Firm* — Muncy, Geissler, Olds & Lowe, P.C.

(57) ABSTRACT

A driving method and a driving device of a display panel, and a display device are provided, wherein, the driving method of the display panel comprises steps of: turning on gates of transistors of an $N^{th}$ row of pixels at a first rising edge moment of a clock signal; charging the $N^{th}$ row of pixels according to a data signal; turning on gates of transistors of an $(N+1)^{th}$ row of pixels before a second rising edge moment of the clock signal; charging the $(N+1)^{th}$ row of pixels according to the data signal; wherein the second rising edge moment follows after the first rising edge moment and neighbors the first rising edge moment, where N is a positive integer.

14 Claims, 5 Drawing Sheets

(58) Field of Classification Search
CPC ..... G09G 3/3677; G09G 2310/0267; G09G 2310/08; G09G 3/3688; G09G 2310/0251; G09G 2320/0223; G09G 2310/02; G09G 3/3266; G09G 2310/0205
See application file for complete search history.

(56) References Cited

U.S. PATENT DOCUMENTS

| | | | | |
|---|---|---|---|---|
| 2007/0132673 | A1* | 6/2007 | Jinno | G09G 3/006 345/76 |
| 2009/0040161 | A1* | 2/2009 | Baek | G11C 19/28 345/94 |
| 2009/0174372 | A1* | 7/2009 | Maeda | G09G 3/3648 320/166 |
| 2010/0164915 | A1 | 7/2010 | Kim | |
| 2011/0228893 | A1 | 9/2011 | Tobita et al. | |
| 2018/0012531 | A1* | 1/2018 | Park | G09G 3/2003 |

FOREIGN PATENT DOCUMENTS

| | | | |
|---|---|---|---|
| CN | 103413532 | A | 11/2013 |
| CN | 106683630 | A | 5/2017 |
| CN | 107068108 | A | 8/2017 |

* cited by examiner

DRIVING METHOD AND DEVICE OF DISPLAY PANEL, AND DISPLAY DEVICE

BACKGROUND

Technical Field

This disclosure relates to the technical field of a display panel, and more particularly to a driving method and a driving device of a display panel, and a display device.

Related Art

The thin film transistor liquid crystal display device (referred to as TFT-LCD) has become the important display platform in the modern IT and the video product. At present, in the liquid crystal display devices with the high refresh frequency above 120 Hz or the three-dimensional transistor (tri-gate) and the like, the thin film transistor (referred to as TFT) has the phenomenon of insufficient charging time of pixels due to the too high scan frequency, and thus the poor display and picture distortion are caused.

SUMMARY

A main objective of this disclosure is to provide a driving method of a display panel, and aims to solve the problem that the charging time of the pixels of the display panel is insufficient, so the frame distortion is prevented and the display effect is improved.

To achieve the above-mentioned objective, this disclosure provides a driving method of a display panel, comprising steps of: turning on gates of transistors of an $N^{th}$ row of pixels at a first rising edge moment of a clock signal; charging the $N^{th}$ row of pixels according to a data signal; turning on gates of transistors of an $(N+1)^{th}$ row of pixels before a second rising edge moment of the clock signal; and charging the $(N+1)^{th}$ row of pixels according to the data signal; wherein the second rising edge moment follows after the first rising edge moment and neighbors the first rising edge moment, where N is a positive integer.

Optionally, the step of turning on gates of transistors of an $(N+1)^{th}$ row of pixels before a second rising edge moment of the clock signal comprises: turning on the gates of the transistors of the $(N+1)^{th}$ row of pixels at a falling edge moment between the first rising edge moment and the second rising edge moment.

Optionally, a time interval from the first rising edge moment to the falling edge moment is different from a time interval from the falling edge moment to the second rising edge moment.

Optionally, a duty cycle of the clock signal is unequal to 50%.

Optionally, the duty cycle of the clock signal is D, where $30\% \leq D < 50\%$ or $50\% < D \leq 70\%$.

Optionally, when the duty cycle of the clock signal is greater than 50%, a pre-charge time of even-numbered rows of pixels of the display panel is shorter than a pre-charge time of odd-numbered rows of pixels.

Optionally, when the duty cycle of the clock signal is smaller than 50%, a pre-charge time of even-numbered rows of pixels of the display panel is longer than a pre-charge time of odd-numbered rows of pixels.

Optionally, a polarity of the data signal is reversed periodically.

In addition, to achieve the above-mentioned objective, this disclosure further provides a driving device of a display panel, comprising: a memory, a processor and a driver program of the display panel stored in the memory and run by the processor, wherein the driver program of the display panel, when being run by the processor, executes steps of: turning on gates of transistors of an $N^{th}$ row of pixels at a first rising edge moment of a clock signal; charging the $N^{th}$ row of pixels according to a data signal; turning on gates of transistors of an $(N+1)^{th}$ row of pixels before a second rising edge moment of the clock signal; and charging the $(N+1)^{th}$ row of pixels according to the data signal; wherein the second rising edge moment follows after the first rising edge moment and neighbors the first rising edge moment, where N is a positive integer.

Optionally, the driver program of the display panel, when being run by the processor, further executes steps of: turning on the gates of the transistors of the $(N+1)^{th}$ row of pixels at a falling edge moment between the first rising edge moment and the second rising edge moment.

Optionally, a time interval from the first rising edge moment to the falling edge moment is different from a time interval from the falling edge moment to the second rising edge moment.

Optionally, a duty cycle of the clock signal is unequal to 50%.

Optionally, the duty cycle of the clock signal is D, where $30\% \leq D < 50\%$ or $50\% < D \leq 70\%$.

Optionally, when the duty cycle of the clock signal is greater than 50%, a pre-charge time of even-numbered rows of pixels of the display panel is shorter than a pre-charge time of odd-numbered rows of pixels.

Optionally, when the duty cycle of the clock signal is smaller than 50%, a pre-charge time of even-numbered rows of pixels of the display panel is longer than a pre-charge time of odd-numbered rows of pixels.

Optionally, a polarity of the data signal is reversed periodically.

In addition, to achieve the above-mentioned objective, this disclosure further provides a driving device, comprising: a display panel and a driving device of a display panel; the driving device of the display panel comprises a memory, a processor and a driver program of the display panel stored in the memory and run by the processor, wherein the driver program of the display panel, when being run by the processor, executes steps of: turning on gates of transistors of an $N^{th}$ row of pixels at a first rising edge moment of a clock signal; charging the $N^{th}$ row of pixels according to a data signal; turning on gates of transistors of an $(N+1)^{th}$ row of pixels before a second rising edge moment of the clock signal; and charging the $(N+1)^{th}$ row of pixels according to the data signal; wherein the second rising edge moment follows after the first rising edge moment and neighbors the first rising edge moment, where N is a positive integer.

The technical solution of this disclosure, by turning on the gates of the transistors of the $N^{th}$ row of pixels at the first rising edge moment of the clock signal, charging the $N^{th}$ row of pixels according to the data signal, turning on the gates of the transistors of the $(N+1)^{th}$ row of pixels before the second rising edge moment of the clock signal, and charging the $(N+1)^{th}$ row of pixels according to the data signal, it is possible to implement the effect that the gates of the transistors of the $(N+1)^{th}$ row of pixels have been turned on and the $(N+1)^{th}$ row of pixels have been charged for a certain period of time when the gates of the transistors of the $N^{th}$ row of pixels are not turned off and the $N^{th}$ row of pixels are still charged. The charging solves the problem that the charging time of the pixels of the display panel is insufficient, so the frame distortion is prevented and the display effect is improved.

The implementation, functional characteristics and advantages of the present disclosure will be further described with reference to the accompanying drawings.

DETAILED DESCRIPTION OF THE INVENTION

The embodiments of the invention will be apparent from the following detailed description, which proceeds with reference to the accompanying drawings, wherein the same references relate to the same elements. The following embodiments are used to exemplify the inventive concepts of the present disclosure and the present invention are not limited herein. In addition, for the convenience of description, the accompany drawings just depict those features related to and necessary for the description of the embodiments, instead of depicting fully structural details. Any feature in one of the following embodiments can be arbitrarily combined with those in other embodiments unless they are mutually exclusive.

Figure 1:
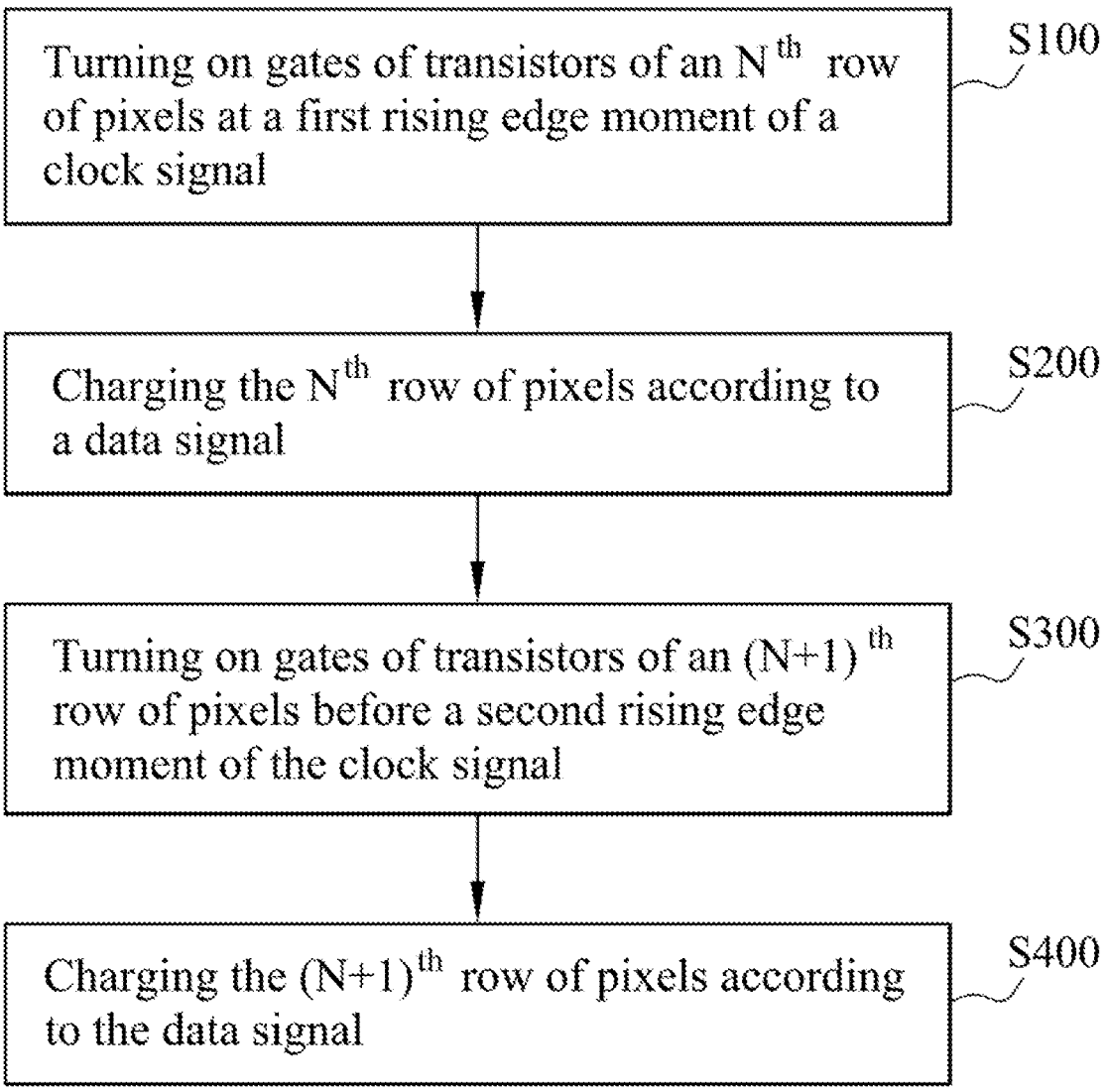
FIG. 1 is a schematic flow chart showing a first embodiment of a driving method of a display panel of this disclosure.

This disclosure provides a driving method of a display panel. Please refer to FIG. 1, which is a schematic flow chart showing a first embodiment of a driving method of a display panel of this disclosure.

The driving method of the display panel in the first embodiment of this disclosure includes the following steps.

In a step S100, gates of transistors of an $N^{th}$ row of pixels are turned on at a first rising edge moment of a clock signal.

In a step S200, the $N^{th}$ row of pixels are charged according to a data signal.

It is to be described that the display panel is applied to the display device. In the display device, the display panel is disposed opposite a backlight module, and the backlight module is used to provide a display light source for the display panel.

The display panel includes a display area, a timing controller, a gate driver and a data driver.

The display area includes multiple pixels arranged in the form of an array on the display area.

The timing controller outputs a clock signal CLK and a gate enable signal STV to the gate driver, and the timing controller also outputs the data signal to the data driver.

The gate driver receives the gate enable signal STV and the clock signal CLK outputted from the timing controller, and outputs control voltages of gates of transistors to a certain row of scan lines. The control voltages can turn on the gates of one row of transistors corresponding to the row of scan lines.

The data driver receives the data signal outputted from the timing controller, and works in conjunction with the gate driver to output the control voltages of the gates of the transistors to a certain row of scan lines, the data signal is converted into the pixel voltage provided to one row of pixels corresponding to the row of scan lines, and the one row of pixels are charged.

Specifically, when the gate driver receives the gate enable signal STV and the clock signal CLK outputted from the timing controller, the gate driver outputs the control voltages of gates of transistors to the $N^{th}$ row of scan lines at the first rising edge moment of the clock signal CLK according to the received clock signal CLK to use the control voltages to turn on the gates of the one row of transistors corresponding to the $N^{th}$ row of scan lines of the display area of the display panel, that is, to turn on the gates of the transistors of the $N^{th}$ row of pixels.

Next, the data driver works in conjunction with the gate driver, and the received data signal is converted into the corresponding pixel voltage provided to one row of pixels corresponding to the $N^{th}$ row of scan lines, that is, the $N^{th}$ row of pixels are charged.

In a step S300, the gates of transistors of an $(N+1)^{th}$ row of pixels are turned on before a second rising edge moment of the clock signal.

In a step S400, the $(N+1)^{th}$ row of pixels are charged according to the data signal.

The second rising edge moment follows after the first rising edge moment, and neighbors the first rising edge moment, where N is a positive integer. That is, the first rising edge moment and the second rising edge moment are two neighboring rising edge moments, wherein the first rising edge moment is before the second rising edge moment. For example, the first rising edge moment may be the rising edge moment of the first cycle of the clock signal CLK, also may be the rising edge moment of the second cycle of the clock signal CLK, and further may be the rising edge moment of the $M^{th}$ cycle of the clock signal CLK. Correspondingly, the second rising edge moment may be the rising edge moment of the second cycle of the clock signal CLK, may also be the rising edge moment of the third cycle of the clock signal CLK, and further may be the rising edge moment of the $(M+1)^{th}$ cycle of the clock signal CLK.

Specifically, at a certain time before the clock signal comes to the second rising edge moment, the gate driver outputs the control voltages of gates of transistors to the $(N+1)^{th}$ row of scan lines (that is, one row of scan lines after the $N^{th}$ row of scan lines) to use the control voltages to turn on the gates of the one row of transistors corresponding to the $(N+1)^{th}$ row of scan lines of the display area of the display panel, that is, to turn on the gates of the transistors of the $(N+1)^{th}$ row of pixels, that is, to turn on the gates of the transistors of the one row of pixels after the $N^{th}$ row of pixels.

Next, the data driver works in conjunction with the gate driver, and the received data signal is converted into the corresponding pixel voltage provided to one row of pixels corresponding to the $(N+1)^{th}$ row of scan lines. In other words, the $(N+1)^{th}$ row of pixels are charged, or the one row of pixels after the $N^{th}$ row of pixels are charged. Thus, the technical effect, in which the gates of the transistors of the $(N+1)^{th}$ row of pixels have been turned on, and the $(N+1)^{th}$ row of pixels have been charged for a certain period of time when the gates of the transistors of the $N^{th}$ row of pixels are not turned off and the $N^{th}$ row of pixels are still charged, is achieved. In addition, it will be appreciated that since N is a positive integer, the pre-charge (except for initiating of the first charge of the row pixels) can be performed before any odd-numbered rows or even-numbered rows of pixels of the display area of the display panel are routinely charged every time.

Thus, it will be appreciated that, in the driving method of the display panel of this disclosure, by turning on the gates of the transistors of the $N^{th}$ row of pixels at the first rising edge moment of the clock signal, charging the $N^{th}$ row of pixels according to the data signal, turning on the gates of the transistors of the $(N+1)^{th}$ row of pixels before the second rising edge moment of the clock signal, and charging the $(N+1)^{th}$ row of pixels according to the data signal, it is possible to implement the effect, in which that the gates of the transistors of the $(N+1)^{th}$ row of pixels have been turned on, and the $(N+1)^{th}$ row of pixels have been charged for a certain period of time when the gates of the transistors of the $N^{th}$ row of pixels are not turned off and the $N^{th}$ row of pixels are still charged. The charging solves the problem that the charging time of the pixels of the display panel is insufficient, so the frame distortion is prevented and the display effect is improved.

Figure 2:
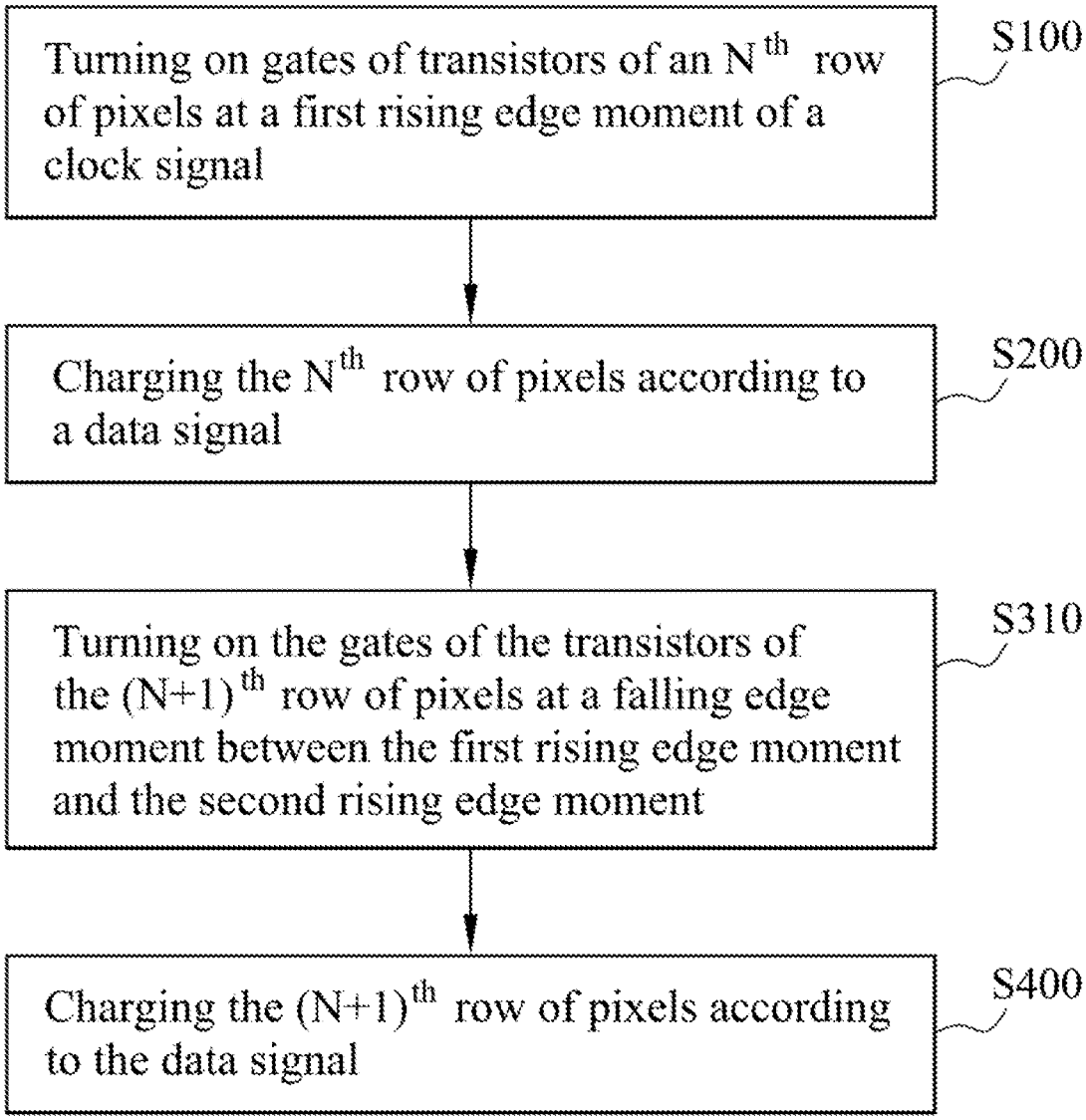
FIG. 2 is a schematic flow chart showing a second embodiment of the driving method of the display panel of this disclosure.

A second embodiment of the driving method of the display panel of this disclosure is provided based on the above-mentioned first embodiment. Referring to FIG. 2, the step S300 in this embodiment includes the following steps.

In a step S310, gates of transistors of an $(N+1)^{th}$ row of pixels are turned on at the falling edge moment between the first rising edge moment and the second rising edge moment.

It will be appreciated that the falling edge moment is inevitably present between the first rising edge moment and the second rising edge moment.

In this embodiment, after the step S200, when the clock signal comes to the falling edge moment between the first rising edge moment and the second rising edge moment, the gate driver outputs the control voltages of gates of transistors to the $(N+1)^{th}$ row of scan lines (that is, one row of scan lines after the $N^{th}$ row of scan lines) to use the control voltages to turn on the gates of the one row of transistors corresponding to the $(N+1)^{th}$ row of scan lines of the display area of the display panel, that is, to turn on the gates of the transistors of the $(N+1)^{th}$ row of pixels, that is, to turn on the gates of the transistors of the one row of pixels after the $N^{th}$ row of pixels.

Next, the data driver works in conjunction with the gate driver, and the received data signal is converted into the corresponding pixel voltage provided to one row of pixels corresponding to the $(N+1)^{th}$ row of scan lines, that is, the $(N+1)^{th}$ row of pixels are charged, that is, the one row of pixels after the $N^{th}$ row of pixels are charged. Thus, the technical effect, in which the gates of the transistors of the $(N+1)^{th}$ row of pixels have been turned on, and the $(N+1)^{th}$ row of pixels have been charged for a certain period of time when the gates of the transistors of the $N^{th}$ row of pixels are not turned off and the $N^{th}$ row of pixels are still charged, is achieved. In addition, it is understood that since N is a positive integer, the pre-charge (except for initiating of the first charge of the row pixels) can be performed before any one row of pixels of the display area of the display panel are routinely charged every time.

Figure 4:
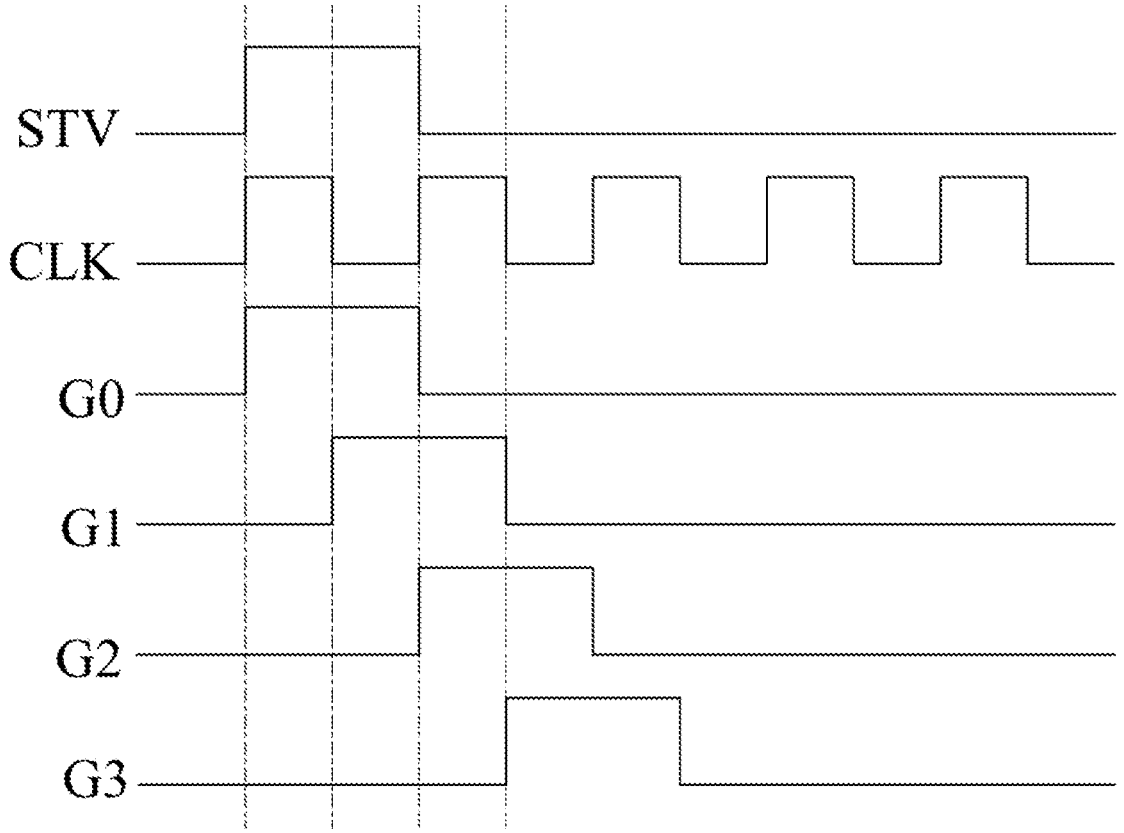
FIG. 4 is a schematic view showing waveforms of scan voltages of scan lines in the display panel of the second embodiment of the driving method of the display panel of this disclosure.

Specifically, referring to FIG. 4, when the gate driver receives the gate enable signal STV and the clock signal CLK outputted from the timing controller, the gate driver outputs the control voltages of gates of transistors to the "G0" row of scan lines at the first rising edge moment of the clock signal CLK to turn on the gates of transistors of the "G0" row of pixels. At this time, the data driver works in conjunction with the gate driver, and the "G0" row of pixels are charged.

Then, the gate driver outputs the control voltages of gates of transistors to the "G1" row of scan lines at the first falling edge moment of the clock signal CLK to turn on the gates of transistors of the "G1" row of pixels. At this time, the data driver works in conjunction with the gate driver, and the "G1" row of pixels are charged. Thus, the technical effect, in which the gates of the transistors of the "G1" row of pixels have been turned on, and the "G1" row of pixels have been charged for a certain period of time when the gates of the transistors of the "G0" row of pixels are not turned off and the "G0" row of pixels are still charged, is achieved.

Then, the gate driver stops outputting the control voltages of gates of transistors to the "G0" row of scan lines at the second rising edge moment of the clock signal CLK to turn off the gates of transistors of the "G0" row of pixels, so that the charging of the "G0" row of pixels ends. At the same time, the gate driver outputs the control voltages of gates of transistors to the "G2" row of scan lines to turn on the gates of transistors of the "G2" row of pixels. At this time, the data driver works in conjunction with the gate driver, and the "G2" row of pixels are charged. Thus, the technical effect, in which the gates of the transistors of the "G2" row of pixels have been turned on, and the "G2" row of pixels have been charged for a certain period of time when the gates of the transistors of the "G1" row of pixels are not turned off and the "G1" row of pixels are still charged, is achieved. The same operations may be analogized to the $N^{th}$ row, and the charging processes from the "G0" row to the $N^{th}$ row of pixels are completed.

In the technical solution of this embodiment, by selecting the turn-on time of the gates of the transistors of the $(N+1)^{th}$ row of pixels as a certain falling edge moment, the technical effect, in which each of rising edge moments is used as the standard time for successively turning on the gates of the transistors of the odd-numbered rows (or even-numbered rows) of pixels, and each of falling edge moments is used as the standard time for successively turning on the gates of the transistors of the even-numbered rows (or odd-numbered rows) of pixels, can be achieved. In addition, because the rising edge moment and the falling edge moment can be distinguished by the level of the level signal, the control is simple, convenient and effective.

Figure 5:
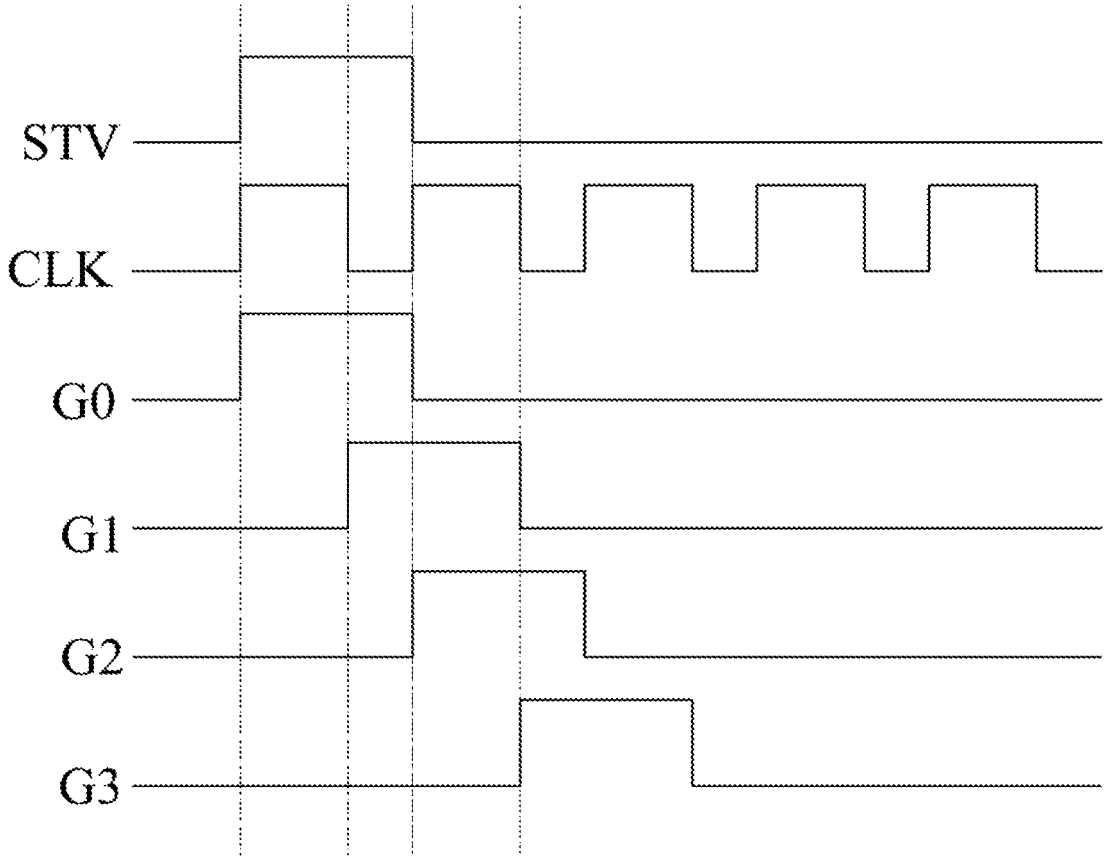
FIG. 5 is a schematic view showing waveforms of scan voltages of scan lines in the display panel of a third embodiment of the driving method of the display panel of this disclosure.

A third embodiment of the driving method of the display panel of this disclosure is provided based on the above-mentioned second embodiment. As shown in FIG. 5, the time interval from the first rising edge moment to the falling edge moment is unequal to the time interval from the falling edge moment to the second rising edge moment in this embodiment.

That is, the duty cycle of the clock signal is unequal to 50% (the duty cycle represents the ratio of the power-on time to the power-off time in one pulse loop). Thus, it is understood as that the ratio of the time interval from the rising edge moment of a certain cycle (pulse loop) of the clock signal CLK to its falling edge moment to the time interval from the falling edge moment to the rising edge moment of the next cycle (pulse loop) is unequal to 50%.

In this embodiment, the duty cycle of the clock signal is greater than 50%, so that the pre-charge times of even-numbered rows (such as "G1" row, "G3" row and the like)

of pixels of the display panel are shorter than the pre-charge times of odd-numbered rows (such as "G0" row, "G2" row and the like) of pixels. Of course, the duty cycle of the clock signal may also be smaller than 50% in other embodiments, so that the pre-charge times of the even-numbered rows of pixels of the display panel are longer than the pre-charge times of the odd-numbered rows of pixels.

Thus, it will be appreciated that in the technical solution of this embodiment, by adjusting the duty cycle, it is possible to make the pre-charge times of odd-numbered rows of pixels and the pre-charge times of even-numbered rows of pixels be adjustable, thus to effectively satisfy the requirements that the pre-charge times of odd-numbered rows and even-numbered rows of pixels are different under some special circumstances, and further to improve the picture quality effect of the display area of the display panel.

A fourth embodiment of the driving method of the display panel of this disclosure is provided based on the above-mentioned third embodiment. In this embodiment, the duty cycle of the clock signal is D, where $30\% \leq D < 50\%$ or $50\% < D \leq 70\%$.

Thus, while the charging effect of odd-numbered rows of pixels and the charging effect of even-numbered rows of pixels are guaranteed, the refresh frequency is also effectively guaranteed, the picture quality effect is also enhanced, and the better energy saving can be achieved.

In addition, it is to be described that, in the embodiment of the driving method of the display panel of this disclosure, the polarity of the data signal is reversed periodically. In this manner, the overall polarization of the display panel is spatially weakened, and the dot inversion effect on the time is implemented to prevent the pixel data level in each of pixels from being kept at the same polarity for a long time, so that the display panel is affected by DC blocking effects and DC residuals, and thus the display effect of the display panel is further improved.

This disclosure further provides a driving device of a display panel, and the driving method of the display panel is applied to the driving device of the display panel.

In first the embodiment of the driving device of the display panel of this disclosure, the driving device of the display panel comprises a memory, a processor and a driving program of the display panel stored in the memory and executed by the processor. When the driving program of the display panel is executed by the processor, the following steps are executed: turning on gates of transistors of an $N^{th}$ row of pixels at a first rising edge moment of a clock signal; charging the $N^{th}$ row of pixels according to a data signal; turning on gates of transistors of an $(N+1)^{th}$ row of pixels before a second rising edge moment of the clock signal, and charging the $(N+1)^{th}$ row of pixels according to the data signal. The second rising edge moment follows after the first rising edge moment and neighbors the first rising edge moment, where N is a positive integer. That is, the first rising edge moment and the second rising edge moment are two neighboring rising edge moments, wherein the first rising edge moment is before the second rising edge moment. For example, the first rising edge moment may be the rising edge moment of the first cycle of the clock signal CLK, also may be the rising edge moment of the second cycle of the clock signal CLK, and further may be the rising edge moment of the $M^{th}$ cycle of the clock signal CLK. Correspondingly, the second rising edge moment may be the rising edge moment of the second cycle of the clock signal CLK, may also be the rising edge moment of the third cycle of the clock signal CLK, and further may be the rising edge moment of the $(M+1)^{th}$ cycle of the clock signal CLK.

It should be noted that the display panel is applied to the display device. In the display device, the display panel is disposed opposite a backlight module, and the backlight module is used to provide a display light source for the display panel.

The display panel includes a display area, a timing controller, a gate driver and a data driver.

The display area includes multiple pixels arranged in the form of an array on the display area.

The timing controller outputs a clock signal CLK and a gate enable signal STV to the gate driver, and the timing controller also outputs the data signal to the data driver.

The gate driver receives the gate enabling signal STV and the clock signal CLK outputted from the timing controller, and outputs control voltages of gates of transistors to a certain row of scan lines. The control voltages can turn on the gates of one row of transistors corresponding to the row of scan lines.

The data driver receives the data signal outputted from the timing controller, and works in conjunction with the gate driver to output the control voltages of the gates of the transistors to a certain row of scan lines. The data signal is converted into the pixel voltage provided to one row of pixels corresponding to the row of scan lines, and the one row of pixels are charged.

Specifically, when the gate driver receives the gate enabling signal STV and the clock signal CLK outputted from the timing controller, the gate driver outputs the control voltages of gates of transistors to the $N^{th}$ row of scan lines at the first rising edge moment of the clock signal CLK according to the received clock signal CLK to use the control voltages to turn on the gates of the one row of transistors corresponding to the $N^{th}$ row of scan lines of the display area of the display panel. In other words, it is to turn on the gates of the transistors of the $N^{th}$ row of pixels.

Next, the data driver works in conjunction with the gate driver, and the received data signal is converted into the corresponding pixel voltage provided to one row of pixels corresponding to the $N^{th}$ row of scan lines. In other words, the $N^{th}$ row of pixels are charged.

At a certain time before the clock signal comes to the second rising edge moment, the gate driver outputs the control voltages of gates of transistors to the $(N+1)^{th}$ row of scan lines (i.e., one row of scan lines after the $N^{th}$ row of scan lines) to use the control voltages to turn on the gates of the one row of transistors corresponding to the $(N+1)^{th}$ row of scan lines of the display area of the display panel. In other words, it is to turn on the gates of the transistors of the $(N+1)^{th}$ row of pixels, or, to turn on the gates of the transistors of the one row of pixels after the $N^{th}$ row of pixels.

Next, the data driver works in conjunction with the gate driver, and the received data signal is converted into the corresponding pixel voltage provided to one row of pixels corresponding to the $(N+1)^{th}$ row of scan lines. In other words, the $(N+1)^{th}$ row of pixels are charged, or, the one row of pixels after the $N^{th}$ row of pixels are charged. Thus, the technical effect, in which the gates of the transistors of the $(N+1)^{th}$ row of pixels have been turned on, and the $(N+1)^{th}$ row of pixels have been charged for a certain period of time when the gates of the transistors of the $N^{th}$ row of pixels are not turned off and the $N^{th}$ row of pixels are still charged, is achieved. In addition, it will be appreciated that since N is a positive integer, the pre-charge (except for initiating of the first charge of the row pixels) can be performed before any one row of pixels of the display area of the display panel are routinely charged every time.

Figure 3:
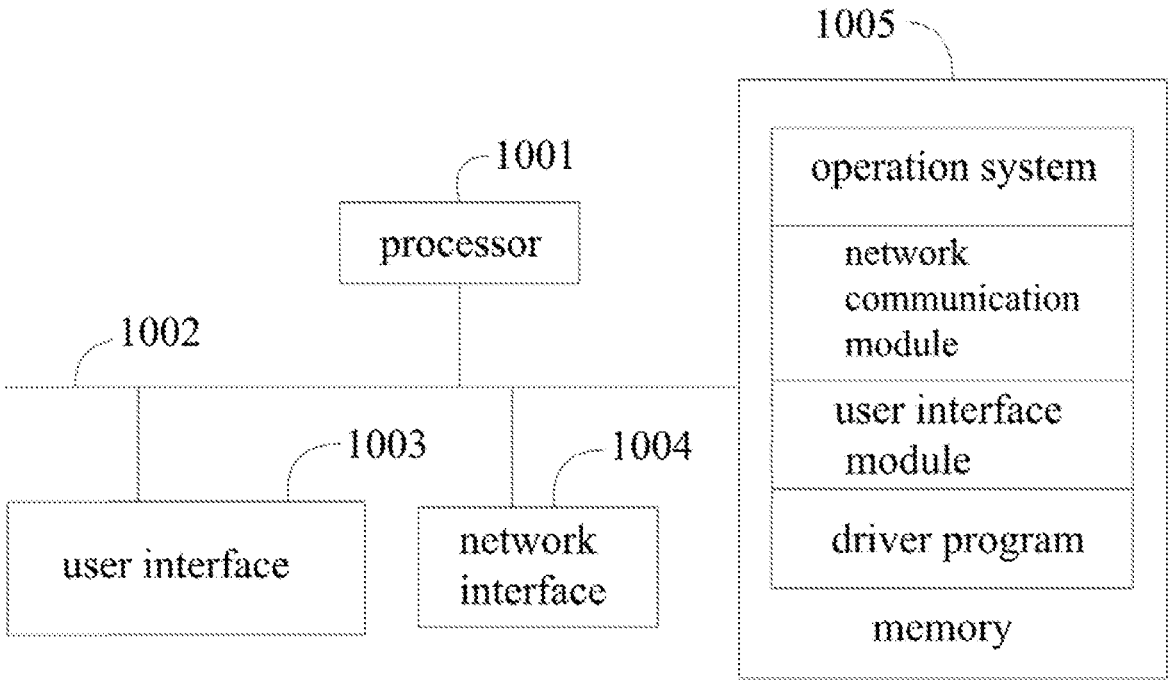
FIG. 3 is a schematic view showing a device structure of a hardware operating environment relating to the embodiment of the driving device of the display panel of this disclosure.

To better understand this disclosure, please refer to FIG. 3, which is a schematic view showing a device structure of a hardware operating environment relating to the first embodiment of the driving device of the display panel of this disclosure.

As shown in FIG. 3, the device may include: a processor 1001, such as a central processing unit (CPU); a network interface 1004; a user interface 1003; a memory 1005; and a communication bus 1002. The communication bus 1002 is used to achieve the connection and communication between these elements; the user interface 1003 may include a display screen (or display), and an input unit such as keyboard, and the user interface 1003 may also optionally include a standard wired interface and a standard wireless interface; the network interface 1004 may optionally include a standard wired interface and a standard wireless interface (such as WI-FI interface); the memory 1005 may be a high-speed RAM memory, and may also be a non-volatile memory, such as a disk memory; and the memory 1005 may optionally be a storage device independent of the processor 1001.

In addition, those skilled in the art will be appreciated that the device structure shown in FIG. 3 does not constitute a limitation on the above-mentioned device, and may include more or fewer components than those shown in the figures, or combine certain components, or different component arrangements may be adopted.

As shown in FIG. 3, the memory 1005 as a computer storage medium may include an operation system, a network communication module, a user interface module and a driver program of the display panel.

In the device as shown in FIG. 3, the network interface 1004 is mainly used to connect to a background server to communicate with the background server; the user interface 1003 is mainly used to connect to a client to communicate data with the client; and the processor 1001 may be used to load a driver program of the display panel stored in the memory 1005, and execute the corresponding operation.

The driving device of the display panel of this disclosure, by turning on the gates of the transistors of the $N^{th}$ row of pixels at the first rising edge moment of the clock signal, charging the $N^{th}$ row of pixels according to the data signal, turning on the gates of the transistors of the $(N+1)^{th}$ row of pixels before the second rising edge moment of the clock signal, and charging the $(N+1)^{th}$ row of pixels according to the data signal, it is possible to implement the effect that the gates of the transistors of the $(N+1)^{th}$ row of pixels have been turned on, and the $(N+1)^{th}$ row of pixels have been charged for a certain period of time when the gates of the transistors of the $N^{th}$ row of pixels are not turned off and the $N^{th}$ row of pixels are still charged. The charging solves the problem that the charging time of the pixels of the display panel is insufficient, so the frame distortion is prevented and the display effect is improved.

Furthermore, based on the first embodiment of the driving device of the display panel of this disclosure and in the second embodiment of the driving device of the display panel of this disclosure, when the above-mentioned driving program of the display panel is run by the processor, the following steps are further executed: turning on the gates of the transistors of the $(N+1)^{th}$ row of pixels at a falling edge moment between the first rising edge moment and the second rising edge moment.

It will be appreciated that the falling edge moment is inevitably present between the first rising edge moment and the second rising edge moment.

In this embodiment, after the step of "charging the $N^{th}$ row of pixels according to a data signal", when the clock signal comes to the falling edge moment between the first rising edge moment and the second rising edge moment, the gate driver outputs the control voltages of gates of transistors to the $(N+1)^{th}$ row of scan lines (that is, one row of scan lines after the $N^{th}$ row of scan lines) to use the control voltages to turn on the gates of the one row of transistors corresponding to the $(N+1)^{th}$ row of scan lines of the display area of the display panel, that is, to turn on the gates of the transistors of the $(N+1)^{th}$ row of pixels, that is, to turn on the gates of the transistors of the one row of pixels after the $N^{th}$ row of pixels.

Next, the data driver works in conjunction with the gate driver, and the received data signal is converted into the corresponding pixel voltage provided to one row of pixels corresponding to the $(N+1)^{th}$ row of scan lines. In other words, the $(N+1)^{th}$ row of pixels are charged, or, the one row of pixels after the $N^{th}$ row of pixels are charged. Thus, the technical effect, in which the gates of the transistors of the $(N+1)^{th}$ row of pixels have been turned on, and the $(N+1)^{th}$ row of pixels have been charged for a certain period of time when the gates of the transistors of the $N^{th}$ row of pixels are not turned off and the $N^{th}$ row of pixels are still charged, is achieved. In addition, it will be appreciated that since N is a positive integer, the pre-charge (except for initiating of the first charge of the row pixels) can be performed before any one row of pixels of the display area of the display panel are routinely charged every time.

Specifically, referring to FIG. 4, when the gate driver receives the gate enabling signal STV and the clock signal CLK outputted from the timing controller, the gate driver outputs the control voltages of gates of transistors to the "G0" row of scan lines at the first rising edge moment of the clock signal CLK to turn on the gates of transistors of the "G0" row of pixels. At this time, the data driver works in conjunction with the gate driver, and the "G0" row of pixels are charged.

Then, the gate driver outputs the control voltages of gates of transistors to the "G1" row of scan lines at the first falling edge moment of the clock signal CLK to turn on the gates of transistors of the "G1" row of pixels. At this time, the data driver works in conjunction with the gate driver, and the "G1" row of pixels are charged. Thus, the technical effect, in which the gates of the transistors of the "G1" row of pixels have been turned on, and the "G1" row of pixels have been charged for a certain period of time when the gates of the transistors of the "G0" row of pixels are not turned off and the "G0" row of pixels are still charged, is achieved.

Then, the gate driver stops outputting the control voltages of gates of transistors to the "G0" row of scan lines at the second rising edge moment of the clock signal CLK to turn off the gates of transistors of the "G0" row of pixels, so that the charging of the "G0" row of pixels ends. At the same time, the gate driver outputs the control voltages of gates of transistors to the "G2" row of scan lines to turn on the gates of transistors of the "G2" row of pixels. At this time, the data driver works in conjunction with the gate driver, and the "G2" row of pixels are charged. Thus, the technical effect, in which the gates of the transistors of the "G2" row of pixels have been turned on, and the "G2" row of pixels have been charged for a certain period of time when the gates of the transistors of the "G1" row of pixels are not turned off and the "G1" row of pixels are still charged, is achieved. The same operations may be analogized to the $N^{th}$ row, and the charging processes from the "G0" row to the $N^{th}$ row of pixels are completed.

In the technical solution of this embodiment, by selecting the turn-on time of the gates of the transistors of the $(N+1)^{th}$ row of pixels as a certain falling edge moment, the technical effect, in which each of rising edge moments is used as the standard time for successively turning on the gates of the transistors of the odd-numbered rows (or even-numbered rows) of pixels, and each of falling edge moments is used as the standard time for successively turning on the gates of the transistors of the even-numbered rows (or odd-numbered rows) of pixels, can be achieved. In addition, because the rising edge moment and the falling edge moment can be distinguished by the level of the level signal, the control is simple, convenient and effective.

Furthermore, based on the second embodiment of the driving device of the display panel of this disclosure and in the third embodiment of the driving device of the display panel of this disclosure, as shown in FIG. 5, the time interval from the first rising edge moment to the falling edge moment is unequal to the time interval from the falling edge moment to the second rising edge moment in this embodiment.

In other words, the duty cycle of the clock signal is unequal to 50% (the duty cycle represents the ratio of the power-on time to the power-off time in one pulse loop). Thus, it will be appreciated that the ratio of the time interval from the rising edge moment of a certain cycle (pulse loop) of the clock signal CLK to its falling edge moment to the time interval from the falling edge moment to the rising edge moment of the next cycle (pulse loop) is unequal to 50%.

In this embodiment, the duty cycle of the clock signal is greater than 50%, so that the pre-charge times of even-numbered rows (such as "G1" row, "G3" row and the like) of pixels of the display panel are shorter than the pre-charge times of odd-numbered rows (such as "G0" row, "G2" row and the like) of pixels. Of course, the duty cycle of the clock signal may also be smaller than 50% in other embodiments, so that the pre-charge times of the even-numbered rows of pixels of the display panel are longer than the pre-charge times of the odd-numbered rows of pixels.

In this embodiment, the duty cycle of the clock signal is greater than 50%, so that the pre-charge times of even-numbered rows (such as "G1" row, "G3" row and the like) of pixels of the display panel are shorter than the pre-charge times of odd-numbered rows (such as "G0" row, "G2" row and the like) of pixels. Of course, the duty cycle of the clock signal may also be smaller than 50% in other embodiments, so that the pre-charge times of the even-numbered rows of pixels of the display panel are longer than the pre-charge times of the odd-numbered rows of pixels.

Thus, it will be appreciated that in the technical solution of this embodiment, by adjusting the duty cycle, it is possible to make the pre-charge times of odd-numbered rows of pixels and the pre-charge times of even-numbered rows of pixels be adjustable, thus to effectively satisfy the requirements that the pre-charge times of odd-numbered rows and even-numbered rows of pixels are different under some special circumstances, and further to improve the picture quality effect of the display area of the display panel.

Furthermore, based on the second embodiment of the driving device of the display panel of this disclosure and in the third embodiment of the driving device of the display panel of this disclosure, the duty cycle of the clock signal is D, where $30\% \leq D < 50\%$ or $50\% < D \leq 70\%$.

Thus, whereas the charging effect of odd-numbered rows of pixels and the charging effect of even-numbered rows of pixels are guaranteed, the refresh frequency is also effectively guaranteed, the quality is also enhanced, and the better energy saving can be achieved.

In addition, it should be noted that, in the embodiment of the driving device of the display panel of this disclosure, the polarity of the data signal is reversed periodically. In this manner, the overall polarization of the display panel is spatially weakened, and the dot inversion effect on the time is implemented to prevent the pixel data level in each of pixels from being kept at the same polarity for a long time, so that the display panel is affected by DC blocking effects and DC residuals, and thus the display effect of the display panel is further improved.

This disclosure further discloses a display device, which includes a display panel, and the driving device of the display panel as mentioned hereinabove. Because the display device adopts all the technical solutions of all the foregoing embodiments, all the beneficial effects brought by the technical solutions of the foregoing embodiments are at least obtained and are not described in detail herein.

It should be appreciated that, in the present disclosure, the terms "comprises", "comprising", "includes", "including" or any other variation thereof, intend to cover a non-exclusive inclusion, such that a process, method, article, article or device not only comprises those elements, but also other elements that are not explicitly listed, or further includes those inherent elements of the process, method, article or device. Unless limited otherwise, element(s) phrased by "include a" or "comprise a" does not exclude that there is/are other such element(s) existing in the process, method, article, or apparatus which already has one such element.

The serial numbers of the above-mentioned embodiments of this disclosure are for the descriptive purpose only and are not representative of the good or bad properties of the embodiments.

With the description of the above-mentioned embodiments, it will be apparent to those skilled in the art that the method of the above-mentioned embodiments can be realized by means of software plus a necessary common hardware platform, and of course plus the hardware, but the former is a better implementation in many cases. Based on this understanding, the technical aspects of this disclosure may be embodied in the form of a software product, either essentially or in the form of contributions to the prior art. The computer software product is stored on a storage medium including a number of instructions for enabling a terminal apparatus to perform the various embodiments of this disclosure.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A driving method of a display panel, comprising steps of:

turning on gates of transistors of an $N^{th}$ row of pixels at a first rising edge moment of a clock signal;

charging the $N^{th}$ row of pixels according to a data signal;

turning on gates of transistors of an $(N+1)^{th}$ row of pixels at a falling edge moment between the first rising edge moment and a second rising edge moment of the clock signal; and charging the $(N+1)^{th}$ row of pixels according to the data signal;

wherein the second rising edge moment follows after the first rising edge moment and neighbors the first rising edge moment, where N is a positive integer; and wherein a time interval from the first rising edge moment to the falling edge moment is different from a time interval from the falling edge moment to the second rising edge moment.

2. The driving method according to claim 1, wherein a duty cycle of the clock signal is unequal to 50%.

3. The driving method according to claim 2, wherein the duty cycle of the clock signal is D, where 30%≤D<50% or 50%<D≤70%.

4. The driving method according to claim 3, wherein when the duty cycle of the clock signal is greater than 50%, a pre-charge time of even-numbered rows of pixels of the display panel is shorter than a pre-charge time of odd-numbered rows of pixels.

5. The driving method according to claim 3, wherein when the duty cycle of the clock signal is smaller than 50%, a pre-charge time of even-numbered rows of pixels of the display panel is longer than a pre-charge time of odd-numbered rows of pixels.

6. The driving method according to claim 1, wherein a polarity of the data signal is reversed periodically.

7. A driving device of a display panel, comprising: a memory, a processor and a driver program of the display panel stored in the memory and run by the processor, wherein the driver program of the display panel, when being run by the processor, executes steps of:

turning on gates of transistors of an $N^{th}$ row of pixels at a first rising edge moment of a clock signal;

charging the $N^{th}$ row of pixels according to a data signal;

turning on gates of transistors of an $(N+1)^{th}$ row of pixels at a falling edge moment between the first rising edge moment and a second rising edge moment of the clock signal; and charging the $(N+1)^{th}$ row of pixels according to the data signal;

wherein the second rising edge moment follows after the first rising edge moment and neighbors the first rising edge moment, where N is a positive integer; and wherein a time interval from the first rising edge moment to the falling edge moment is different from a time interval from the falling edge moment to the second rising edge moment.

8. The driving device according to claim 7, wherein a duty cycle of the clock signal is unequal to 50%.

9. The driving device according to claim 8, wherein the duty cycle of the clock signal is D, where 30%≤D<50% or 50%<D≤70%.

10. The driving device according to claim 9, wherein when the duty cycle of the clock signal is greater than 50%, a pre-charge time of even-numbered rows of pixels of the display panel is shorter than a pre-charge time of odd-numbered rows of pixels.

11. The driving device according to claim 9, wherein when the duty cycle of the clock signal is smaller than 50%, a pre-charge time of even-numbered rows of pixels of the display panel is longer than a pre-charge time of odd-numbered rows of pixels.

12. The driving device according to claim 7, wherein a polarity of the data signal is reversed periodically.

13. A display device, comprising:

a display panel; and the driving device of a display panel according to claim 7.

14. The driving device according to claim 13, wherein a polarity of the data signal is reversed periodically.

* * * * *